United States Patent [19]

Jordan et al.

[11] Patent Number: 4,722,482

[45] Date of Patent: Feb. 2, 1988

[54] ELECTRO-MAGNETIC INJECTION VALVE HAVING ENHANCED VALVE-OPENING FORCES

[75] Inventors: Wolfgang Jordan, Grevenbroich; Dieter Thonnessen, Viersen, both of Fed. Rep. of Germany

[73] Assignee: Pierburg GmbH & Co. KG, Neuss, Fed. Rep. of Germany

[21] Appl. No.: 862,101

[22] Filed: May 12, 1986

[30] Foreign Application Priority Data

May 10, 1985 [DE] Fed. Rep. of Germany ..... 3516918

[51] Int. Cl.[4] ..... B05B 1/30

[52] U.S. Cl. ..... 239/585; 239/124; 251/129.14

[58] Field of Search ..... 239/585, 124; 251/129.14

[56] References Cited

U.S. PATENT DOCUMENTS

| | | | |
|---|---|---|---|
| 3,731,880 | 5/1973 | Williams | 239/585 |
| 4,264,040 | 4/1981 | Saito | 239/585 |
| 4,434,765 | 3/1984 | Eshelman | 239/585 X |
| 4,471,914 | 9/1984 | Hafner et al. | 239/585 |
| 4,570,598 | 2/1986 | Samson et al. | 239/585 X |

FOREIGN PATENT DOCUMENTS

| | | | |
|---|---|---|---|
| 2136500 | 9/1984 | United Kingdom | 239/585 |

*Primary Examiner*—Andres Kashnikow
*Assistant Examiner*—Daniel R. Edelbrock
*Attorney, Agent, or Firm*—Roberts, Spiecens & Cohen

[57] ABSTRACT

An electrmagnetic intermittent injection valve for supplying fuel to an intake duct of an internal combustion engine comprising a hollow body having a fuel inlet for admission of fuel from a fuel supply, a fuel outlet for supply of fuel to an intake duct of an internal combustion engine, and a fuel return for returning fuel back to the fuel supply. A ball valve is movable in the body between a first position in which the fuel outlet is closed and a second position in which the fuel outlet is open. A spring acts on the ball to urge the ball to the first position. A soft iron core is disposed in the body in facing relation with the ball, the body including a housing end portion of soft iron facing the ball valve. A coil in the body serves for energizing the core and the housing end portion for producing a magnetic field having lines of flux acting on the ball valve to urge the ball valve to the second position against the resilient opposition of the spring. The core and housing end portion are arranged in relation to the ball valve such that the lines of flux produced by the housing end portion form an angle therebetween less than 90°.

10 Claims, 1 Drawing Figure

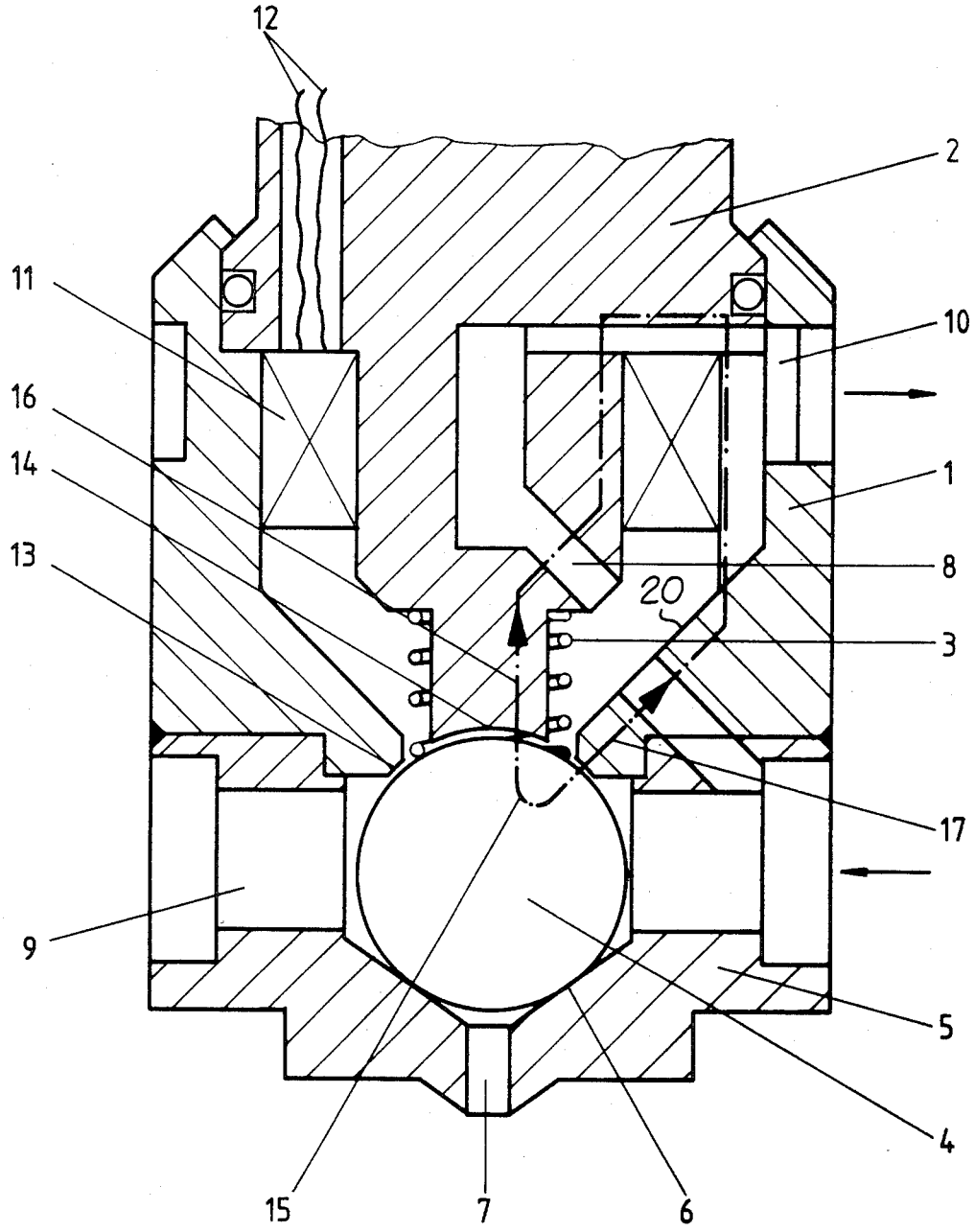
12
2
11
10
16
14
1
13
8
20
3
17
9
5
4
15
7
6

ELECTRO-MAGNETIC INJECTION VALVE HAVING ENHANCED VALVE-OPENING FORCES

FIELD OF THE INVENTION

The invention relates to an electromagnetic injection valve for the intermittent feeding of fuel to the intake duct of an internal combustion engine and particularly to a valve fuel outlet located between a fuel inlet and a fule return which is controlled by a valve closure member. The valve closure member is attracted, in energized condition, by a magnetic field developed by an electric coil in combination with a soft-iron core and an end portion of a housing of the valve.

PRIOR ART

Injection valves whose valve closure member is formed by a ball are disclosed, for instance, in DE-OS No. 31 11 327 and EPO No. 063952 A1. Such valves preferably have switching times within the millisecond range. In order to achieve such rapid switching times, it is necessary to keep the moving masses small and make the magnetic forces large. At the same time, it is desirable to keep the size of the injection valve small and, because of energy absoprtion and heat development, to keep the magnetic coil small. there are thus contradictions between the desire for a small magnetic coil and the desire for large magnetic actuating forces. In the known injection valves, electromagnetic actuating forces are developed which are not sufficiently utilized since the lines of flux passing through the ball form an angle of approximately 90° between the end portion of the housing and the magnet core whereby only the lines of flux acting in the axial direction of the magnetic core are active in the opening direction of the valve closure member.

SUMMARY OF THE INVENTION

An object of the invention is to provide an electromagnetic injection valve in which an increase in the active magnetic forces is achieved by a structural development to obtain a rapid response time, despite the small size of the coil.

In accordance with the invention, this object is achieved by a construction in which the valve closure member is a ball and the soft-iron core and end portion of the housing are arranged with respect to the ball such that the magnetic lines of flux passing through the ball form an angle of less than 90%, and preferably 45°, between the core and the end portion of the housing.

By virtue of the construction according to the invention, the magnetic force acting on the ball to open the fuel outlet is formed by two vectors which act in the opening direction of the ball. Accordingly, with the same number of turns in the coil, a greater opening force is developed which results in better response behavior as compared to in the known valves.

In a preferred embodiment of the invention, the end portion of the housing contains a fuel return outlet and the fuel inlet and the fuel outlet are provided in a non-magnetic member which is secured to the end portion of the housing and is provided with the seat for the ball.

BRIEF DESCRIPTION OF THE DRAWING

One embodiment of the invention is shown diagrammatically in the sole FIGURE of the drawing and will be described in detail below.

DETAILED DESCRIPTION OF A PREFERRED EMBODIMENT OF THE INVENTION

In the drawing there is seen an electromagnetic injection valve for supplying fuel to an intake duct or manifold (not shown) of an internal combustion engine. The valve comprises an end portion of a housing 1 made of soft iron or equivalent magnetic material forming a hollow body. Secured within the hollow body is a core 2 of soft iron or equivalent magnetic material having a free end 14 of concave shape. The housing end portion 1 has a frustoconical recess 20 in which the core 2 extends coaxially. The housing end portion 1 has an annular free end 13 of concave shape.

A ball 4 is disposed opposite the concave free ends 13 and 14 of housing end portion 1 and core 2 respectively. A spring 3 acts on the ball 4 to urge the ball away from the free ends 13 and 14 to form a uniform gap between the ball 4 and the free ends 13 and 14.

A member 5 of non-magnetic material is secured to the housing end portion 1 to confine the ball 4 for movement in a space between the end portion 1, core 2 and member 5. The member 5 has a frusto-conical valve seat 6 coaxially facing the core and the spring 3 urges the ball 4 against the valve seat 6. The member 5 has an annular fuel inlet 9 connected to a fuel supply (not shown), and a fuel outlet 7 adapted for connection to the inlet duct (not shown) of the internal combustion engine. Communication between the fuel inlet 9 and the fuel outlet 7 is controlled by ball 4. Coil 11 is disposed in the housing end portion 1 around core 2 and is connected by electrical leads 12 to a voltage source (not shown) for energizing the core and the housing end portion to produce a magnetic field acting on the ball 4 to urge the ball to a position to open outlet 7.

The housing end portion 1 has an outlet 10 for return of fuel to the fuel supply. Fuel supplied at inlet 9 can flow between the ball 4 and the free ends of the core 2 and housing end portion 1 through the passageway between the core 2 and frusto-conical recess 20 to the outlet 10 for return of fuel to the supply. A by-pass passage 8 is formed in the core 2.

When the coil 11 is energized and ball 4 is displaced to open fuel outlet 7 a portion of the fuel flows to the outlet 7 and a portion flows past the ball to the return outlet 10 via the passageway in recess 20 and the by-pass passage 8 to cool the core 2, housing end portion 1 and coil 11. When the ball 4 is closed on seat 6, the full fuel flow at inlet 9 travels to the fuel return 10.

Further parts of the valve have not been shown as they are conventional and are not relevant to the invention.

The member 5 with the valve seat 6 is rigidly connected to the end portion of the housing 1 and opening 20 in the end portion of the housing tapers towards the free end of the core 2 to form a frusto-conical cavity, which has an opening surrounding the core and facing the ball 4. The free end of the core is centrally disposed within this opening. The concave free end 13 of the housing 1 and the free end 14 of the magnet core together form a substantially spherical surface which lies opposite a spherical segment of the ball 4 and is concentric therewith. When coil 11 is energized, magnetic lines of flux 15 are developed in the ball 4 from two flux vectors 16 and 17 which respectively act in core 2 and housing 1 in a direction to urge the ball to open the outlet 7. the lines of flux produced by the flux vectors 16 and 17 form an angle therebetween of about 45° to cooperatively produce force components acting to displace the ball 4 in a direction away from the outlet 7. In the specific embodiment which has been disclosed, the frusto-conical disposition of the housing end portion at free end 13, produces the vector 17 which is inclined with respect to the vector 16 so that the vector 17 will have a component additive to the vector 16 for applying forces on the ball 4 to open the outlet 7.

In this way, the force acting on ball 4 to open the fuel outlet 7 is enhanced as the end portion of the housing participates in the development of the force.

Although the invention has been described in relation to a specific embodiment thereof, it will become apparent to those skilled in the art that numerous modifications and variations can be made within the scope and spirit of the invention as defined in the attached claims.

What is claimed is:

1. An electromagnetic intermittent injection valve for supplying fuel to an intake duct of an internal combustion engine, said valve comprising a hollow body having a fuel inlet for admission of fuel from a fuel supply, a fuel outlet for supply of fuel to an intake duct of an internal combustion engine, and a fuel return for returning fuel back to the fuel supply, a ball valve in said body movable between a first position in which the fuel outlet is closed and all the fuel supplied to the fuel inlet flows to the fuel return and a second position in which the fuel outlet is open and the fuel supplied to the fuel inlet is distributed to the fuel outlet and the fuel return, resilient means acting on said ball to urge the ball to said first position, a soft iron core disposed in said body in facing relation with said ball, said body including a housing end portion of soft iron facing said ball valve, a coil in said body for energizing said core and said housing end portion for producing a magnetic field having lines of flux acting on said ball valve to urge the ball valve to said second position against the resilient opposition of said resilient means, said core and said housing end portion being arranged in relation to said ball valve to define respective air gaps therewith, the air gap between the core and the ball valve and the air gap between the housing end portion and the ball valve forming an angle with one another such that the lines of flux produced by the core and the lines of flux produced by the housing end portion form an angle therebetween less than 90° to provide components respectively acting to displace the ball valve to said second position.

2. A valve as claimed in claim 1 wherein said angle between the lines of flux produced by the core and the lines of flux produced by the housing end portion is 45°.

3. A valve as claimed in claim 2 wherein said body further includes a member of non-magnetic material secured to said housing end portion and having a seat for said ball valve.

4. A valve as claimed in claim 3 wherein said member of non-magnetic material is provided with said fuel outlet and said fuel inlet.

5. A valve as claimed in claim 1 wherein said housing end portion and said core have respective concave surfaces facing said ball valve to form said gaps therewith, said gaps each extending over a different portion of the periphery of the ball valve.

6. A valve as claimed in claim 5 wherein said housing end portion has a frusto-conical recess therein in which said core extends coaxially, said concave surfaces on said core and housing end portion being disposed in a common spherical plane concentric with said ball valve.

7. A valve as claimed in claim 6 wherein said core and said housing end portion form a passageway in communication with said gap and with said fuel outlet.

8. A valve as claimed in claim 7 wherein said coil is disposed in said passageway.

9. A valve as claimed in claim 8 wherein said core has a by-pass passage therein communicating with said passageway and connected to said fuel return.

10. A valve as claimed in claim 5 wherein the positioning of the core and the housing end portion relative to said ball valve disposes said gaps so that said lines of flux extend perpendicularly to said gaps.

* * * * *